United States Patent [19]

Ichioka

[11] Patent Number: 4,724,931

[45] Date of Patent: Feb. 16, 1988

[54] GROUP-SUPERVISORY APPARATUS FOR ELEVATOR

[75] Inventor: Youichi Ichioka, Tokyo, Japan

[73] Assignee: Mitsubishi Denki Kabushiki Kaisha, Japan

[21] Appl. No.: 933,373

[22] Filed: Nov. 21, 1986

[30] Foreign Application Priority Data

Nov. 22, 1985 [JP] Japan ..... 60-262928

[51] Int. Cl.[4] ..... B66B 1/46

[52] U.S. Cl. ..... 187/101; 187/121

[58] Field of Search ..... 187/121, 124, 101

[56] References Cited

U.S. PATENT DOCUMENTS 4,128,143 12/1978 Petterson et al. ..... 187/101
4,193,478 3/1980 Keller et al. ..... 187/101
4,376,930 3/1983 Sasao ..... 187/121

FOREIGN PATENT DOCUMENTS 55-89175 7/1980 Japan .

*Primary Examiner*—William M. Shoop, Jr.
*Assistant Examiner*—W. E. Duncanson, Jr.
*Attorney, Agent, or Firm*—Leydig, Voit & Mayer

[57] ABSTRACT

An elevator group-supervisory apparatus in which elevator group-supervisory means is fed through read means with elevator status signals, for example, hall call, cage call and direction signals derived from the display equipment of an existing elevator such as a hall call response lamp, cage call response lamp, door opening or closing button and cage position indicating lamp that are standardized irrespective of differences in the date of manufacture and the manufacturer of the existing elevator, and manipulation signals that are the processed results of the group-supervisory means are delivered to the manipulation equipment of the existing elevator so as to control the control circuit of the existing elevator. Therefore, even when the control circuit of the existing elevator has been made by any manufacturer different from the manufacturer of the elevator group-supervisory apparatus or when the existing elevator is of a model in a different year, the control circuit for receiving group-supervisory commands need not be remodeled, and the group supervision of the elevator can be readily altered.

8 Claims, 7 Drawing Figures

GROUP-SUPERVISORY APPARATUS FOR ELEVATOR

BACKGROUND OF THE INVENTION

This invention relates to a group-supervisory apparatus for an elevator which is suited to alter the group supervision of the existing elevator already constructed.

A prior-art elevator control apparatus for altering the group supervision of an existing elevator is as shown in FIG. 5.

Referring to FIG. 5, numeral 1 designates the control unit of an existing elevator, and numeral 2 designates a control unit added for altering the group supervision of the existing elevator. The additional control unit 2 comprises a computer 2*a* which executes group-supervisory processing, a relay driver 2*b* which is controlled by the computer 2*a*, and a control relay-substitute relay 2*c* and a transfer relay 2*d* which are connected to the relay driver 2*b*. Besides, symbol 2*e* denotes an operating power source for the substitute relay 2*c* as well as the transfer relay 2*d*, symbol $2c_1$ denotes the normally-open contact of the substitute relay 2*c*, symbol $2d_1$ denotes the normally-open contact of the transfer relay 2*d*, and symbol $2d_2$ the normally-closed contact of the transfer relay 2*d*.

The control unit 1 of the existing elevator has a control relay 1*a* which is the direction relay or stoppage relay of an existing elevator control circuit, and a condition circuit 1*b* therefor. The control relay 1*a* and the condition circuit 1*b* are connected in series across an operating power source 1*c*. When the elevator group supervision is to be altered, a line 1*d* which connects the control relay 1*a* with the condition circuit 1*b* is disconnected as indicated by a mark x, and the control relay 1*a* and the condition circuit 1*b* are connected by another line 1*e* instead of the line 1*d*. Also, the normally-closed contact $2d_2$ of the transfer relay 2*d* is connected in series with the line 1*e*. Further, a series circuit consisting of the normally-open contact $2d_1$ of the transfer relay 2*d* and the normally-open contact $2c_1$ of the control relay-substitute relay 2*c* is connected in parallel with the normally-closed contact $2d_2$.

Owing to such changes, when the transfer relay 2*d* is energized through the relay driver 2*b* by a command given from the computer 2*a*, the control relay 1*a* is disconnected from the existing condition circuit 1*b* by the normally-closed contact $2d_2$ now opened, and the normally-open contact $2d_1$ is closed. Therefore, the control relay 1*a* is energized or deenergized depending upon the state of the normally-open contact $2c_1$ of the control relay-substitute relay 2*c* which is controlled by the command of the computer 2*a*.

Accordingly, when the control relay 1*a* is the direction relay or the stoppage determining relay, the control of the energization/deenergization of such a relay in the existing elevator control circuit is permitted by the computer 2*a*, with the result that the group-supervisory control of the elevator by the computer 2*a* becomes possible.

When the conditions of the control relay-substitute relay 2*c* which is controlled by the computer 2*a* are made the same as those of the condition circuit 1*b*, the same elevator control as that performed before the alteration can be realized, and when the conditions are made different from those of the condition circuit 1*b*, a different elevator control can be realized.

With the prior-art elevator control apparatus for altering the elevator group supervision as stated above, the group supervision is performed by energizing/deenergizing the control relay 1*a* of the existing elevator control unit 1 by means of the computer 2*a* of the additional control unit 2, and hence, the control apparatus needs to be designed with the full knowledge of the existing elevator control unit 1. This has posed the problem of difficulty in the alteration of the group supervision of an old elevator for which design materials etc. are not kept in custody or an elevator made by a manufacturer different from that of the additional control unit, for which drawings etc. are not readily available.

SUMMARY OF THE INVENTION

The object of this invention is to solve the problem mentioned above, and its main object is to provide an elevator group-supervisory apparatus by which even an old elevator with design materials etc. not kept or an elevator made by a different manufacturer or an elevator for which it is difficult to obtain drawings etc. can have its group supervision control altered with ease.

The elevator group-supervisory apparatus according to this invention comprises input means to read elevator status sigals from the display equipment of an existing elevator, and elevator group-supervisory means to deliver manipulation signals to the manipulation equipment of the existing elevator on the basis of the elevator status signals from the input means.

With this invention, the elevator group-supervisory means is fed through the read means with the elevator status signals, e. g., hall call, cage call and direction signals derived from the display equipment of the existing elevator such as a hall call response lamp, cage call response lamp, door opening or closing button, and cage position indicating lamp which are standardized irrespective of differences in the date of manufacture and the manufacturer of the existing elevator, and the manipulation signals which are results processed by the group-supervisory means are delivered to the manipulation equipment of the existing elevator so as to control the control circuit of the existing elevator. Therefore, even when the control circuit of the existing elevator has been made by any manufacturer other than the manufacturer of the elevator group-supervisory apparatus or when the existing elevator is of a model in a different year, the control circuit for receiving group-supervisory commands need not be remodeled, and the alteration of the group supervision of the elevator becomes readily possible.

BRIEF DESCRIPTION OF THE DRAWINGS

Throughout the drawings, the same symbols indicate identical or corresponding portions.

DESCRIPTION OF THE PREFERRED EMBODIMENTS

Now, embodiments of this invention will be described with reference to the drawings.

Figure 1:
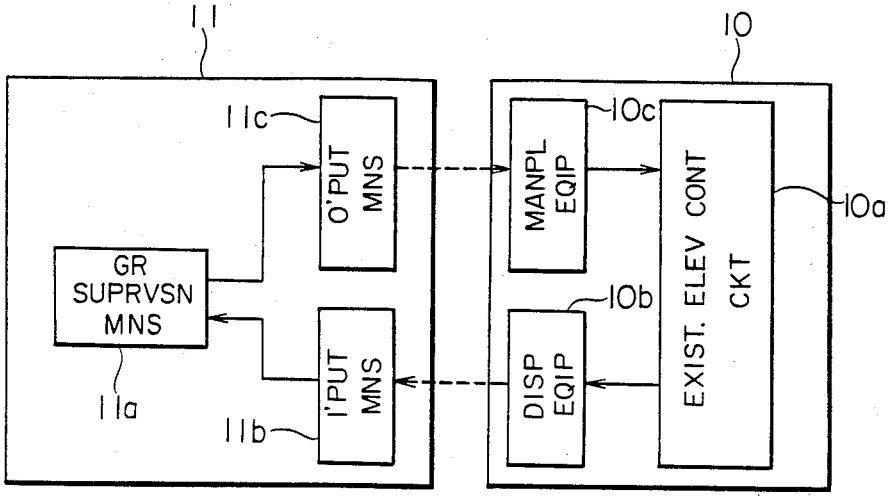
FIG. 1 is a block diagram showing the fundamental arrangement of an elevator group-supervisory apparatus according to this invention.

FIG. 1 shows the fundamental arrangement of an elevator group-supervisory apparatus according to this invention. Numeral 10 designates an existing elevator unit already installed, and numeral 11 an additional control unit for altering the group supervision of the existing elevator unit 10.

The existing elevator unit 10 is constructed of a control circuit 10*a* for an existing elevator, display equipment 10*b* which is operated by an output signal from the control circuit 10*a* and which displays the status of the elevator, and manipulation equipment 10*c* which gives a command to the control circuit 10*a*. On the other hand, the additional control unit 11 for altering the group supervision is constructed of group supervision means 11*a* for executing group-supervisory processing, input means 11*b* for loading the group supervision means 11*a* with an elevator status signal displayed on the display equipment 10*b* of the existing elevator unit 10, and output means 11*c* for supplying the manipulation equipment 10*c* of the existing elevator unit 10 with a command signal processed in the group supervision means 11*a* on the basis of the elevator status signal.

Figure 2A:
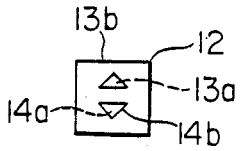
FIGS. 2A, 2B and 2C are explanatory views showing examples of display equipment and manipulation equipment in this invention.
Figure 2B:
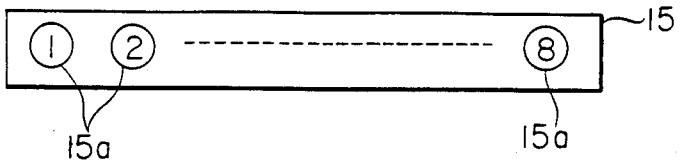
Figure 2C:
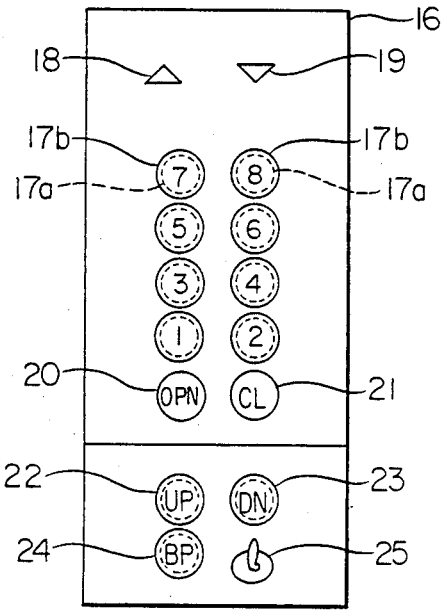

FIGS. 2A thru 2C show concrete examples of the display equipment 10*b* and the manipulation equipment 10*c*. The display equipment 10*b* includes the up call response lamp 13*a* and down call response lamp 14*a* of a hall call buttom 12 (FIG. 2A), the cage position indicating lamps 15*a* of an indicator 15 disposed in a hall or a cage (FIG. 2B), the cage call response lamps 17*a* of a cage manipulation panel 16 and the up direction lamp 18 and down direction lamp 19 thereof (FIG. 2C), and so forth.

The manipulation equipment 10*c* includes the up call button 13*b* and down call button 14*b* of the hall call button 12 (FIG. 2A), the cage call buttons 17*b* of the cage manipulation panel 16 and the door opening button 20, door closing button 21, up botton 22, down button 23, bypass button 24 and with-operator transfer switch 25 thereof (FIG. 2C), and so forth.

In the elevator group-supervisory apparatus constructed as described above, the elevator status signal of the display equipment 10*b* is fed into the group supervision means 11*a* through the input means 11*b*. A manipulation signal which is the result of group-supervisory processing in this group supervision means is delivered to the manipulation equipment 10*c* through the output means 11*c*, and the existing elevator control circuit 10*a* is controlled by this manipulation equipment so as to group-supervise the elevator.

Figure 3:
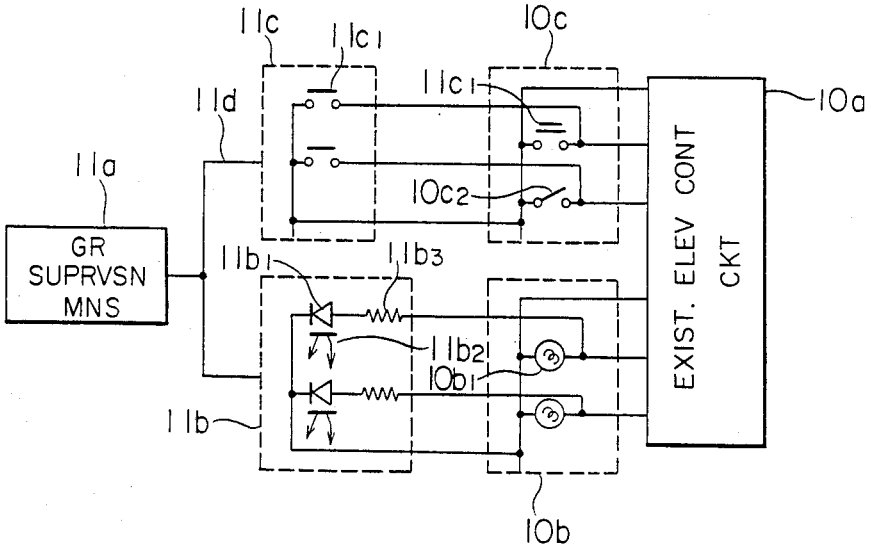
FIGS. 3 and 4 are circuit diagrams each showing a practicable embodiment of the fundamental system arrangement of this invention.

FIG. 3 shows a practicable embodiment of the fundamental arrangement of this invention illustrated in FIG. 1. A computer is used as the group supervision means 11*a*. An input interface constructed of photocouplers each being composed of a light emitting diode $11b_1$ and a phototransistor $11b_2$, the input side of the former and the output side of the latter being electrically insulated, is utilized as the input means 11*b* for the status signals from the display equipment 10*b*. Further, an output interface constructed of output contacts $11c_1$ is utilized as the output means 11*c* for the signals from the group supervision means 11*a* to the manipulation equipment 10*c*. The interfaces 11*b* and 11*c* and the computer 11*a* are connected by a bus 11*d*. In addition, lamps $10b_1$ are employed for the display equipment 10*b* as explained in conjunction with FIGS. 2A–2C. The light emitting diodes $11b_1$ of the photocouplers constituting the input interface 11*b* are connected in parallel with the lamps $10b_1$ through current limiting resistors $11b_3$. Further, manipulation buttons $10c_1$ or manipulation switches $10c_2$ as explained in conjunction with FIGS. 2A–2C are employed for the manipulation equipment 10*c*. The output contacts $11c_1$ constituting the output interface 11*c* are connected in parallel with the manipulation button $10c_1$ and the manipulation switch $10c_2$.

In the group-supervisory apparatus thus constructed, the lit-up or put-out states of the lamps $10b_1$ displaying the statuses of the elevator are detected by the photocouplers of the input interface 11*b*, and the detection signals are applied to the computer 11*a* through the bus 11*d*.

Besides, the manipulation signals which are the results of the group-supervisory processing in the computer 11*a* as based on the elevator status signals are delivered to the manipulation equipment 10*c* of the existing elevator through the output contacts $11c_1$ of the output interface 11*c*.

The operation of this invention will be described more concretely. It is assumed in FIG. 3 that the switch $10c_1$ be the cage call button and that the lamp $10b_1$ be the corresponding response lamp. Then, the cage call button $10c_1$ and the contact $11c_1$, which is actuated by a command from the added group supervision means 11*a*, are connected in parallel.

The signal of the cage call button $10c_1$ manipulated by a passenger in a cage is applied to the existing elevator control circuit 10*a*, and a cage call is registered. As a result, the response lamp $10b_1$ is lit up.

The signal of the lighting-up operation of the response lamp $10b_1$ is supplied to the group supervision means 11*a* through the input interface 11*b*, and the group supervision means 11*a* acknowledges the cage call allotted to the cage. Such acknowledgement of the presence or absence of cage calls is made for respective cages.

Further, the group supervision means 11*a* is similarly supplied with the lit-up states of the display equipment to acknowledge the running statuses of the respective cages. More specifically, information on the running direction of the cage is input to the group supervision means 11*a* in accordance with the lit-up state of the up direction lamp 18 or down direction lamp 19 of the cage manipulation panel 16, and information items on the positions of the respective cages are input in accordance with the lit-up states of the cage position indicating lamps 15*a*, . . . Further, up hall calls and down hall calls in respective halls are input as information items in accordance with the operating states of the response lamps 13*a* and 14*a*.

On the basis of these items of cage call information, hall call information, cage position information and cage running direction information received, the group supervision means 11*a* allots the hall calls to the cages which are thought the most suitable.

The allotment is performed in such a way that the group supervision means 11*a* gives commands so as to close the contacts $11c_1$.

Besides the hall call allotment control thus far described, the group supervision means 11*a* performs the controls of actuating the up button 22, down button 23 or bypass button 24 to set the running direction of the cage, actuating the cage call button of a main floor to call the cage back to the main floor, and actuating the bypass buttons to bypass some hall calls.

In this way, the group supervision means 11*a* realizes the altered group-supervisory control.

The embodiment of FIG. 3 can be readily performed if the electrical ratings of the manipulation buttons, the manipulation switches and the various indicator lamps are clear, and it affords a simple arrangement.

Figure 4:
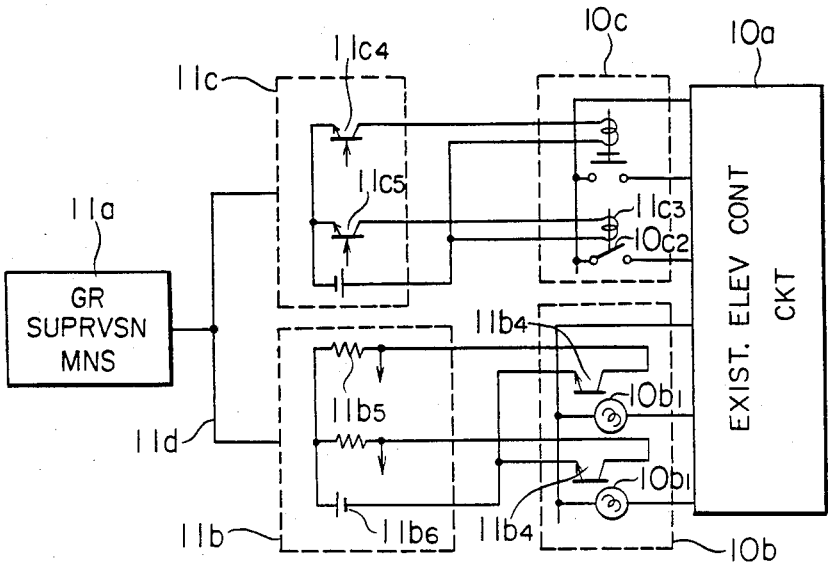
Figure 5:
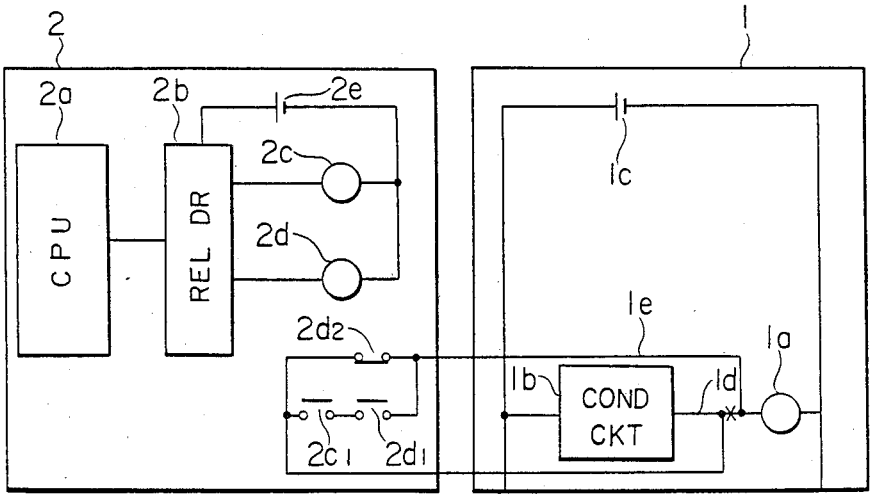
FIG. 5 PRIOR ART
FIG. 5 is a circuit diagram showing an elevator group-supervisory apparatus in a prior art system.

FIG. 4 shows another practicable embodiment of this invention corresponding to the fundamental arrangement in FIG. 1, and the same portions as in FIG. 3 shall be elucidated with identical symbols affixed thereto.

Referring to FIG. 4, the light beams of indicator lamps $\mathbf{10}b_1$ employed for the display equipment 10*b* of the existing elevator already installed are detected by photosensors such as phototransistors $\mathbf{11}b_4$ which constitute the input interface 11*b*. The lit-up or put-out states of the indicator lamps $\mathbf{10}b_1$ are detected in terms of the potential changes of the nodes between the photosensors $\mathbf{11}b_4$ and load resistors $\mathbf{11}b_5$ connected in series with them as developed by the turn-on/off of the photosensors. The detection signals are fed into the computer 11*a* through a bus 11*d* as the elevator status signals. Symbol $\mathbf{11}b_6$ denotes a D.C. power source.

In order to actuate a manipulation button $\mathbf{10}c_1$ and a manipulation switch $\mathbf{10}c_2$ used as the manipulation equipment 10*c*, the mechanical output signals of a button actuator $\mathbf{11}c_2$ and a switch actuator $\mathbf{11}c_3$ or the likes constituting the output interface 11*c* are employed. These actuators $\mathbf{11}c_2$ and $\mathbf{11}c_3$ are connected to the D.C. power source $\mathbf{11}c_6$ through driving transistors $\mathbf{11}c_4$ and $\mathbf{11}c_5$ which control the corresponding actuators.

Accordingly, the actuator driving transistors $\mathbf{11}c_4$ and $\mathbf{11}c_5$ are turned 'on' or 'off' by the elevator manipulation signals delivered from the computer 11*a* through the bus 11*d* to the output interface 11*c*, and the button actuator $\mathbf{11}c_2$ and the switch actuator $\mathbf{11}c_3$ are thus operated to depress the manipulation button $\mathbf{10}c_1$ or change-over the manipulation switch $\mathbf{10}c_2$, whereby the elevator manipulation signals are supplied to the manipulation equipment 10*c*.

In the embodiment of FIG. 4, the existing control panel and the additional control unit are electrically independent of each other. Therefore, the embodiment is readily applicable even when the electical ratings of the manipulation buttons, the manipulation switches and the indicator lamps are unknown.

As described above, according to this invention, the group supervision of an elevator is altered by feeding elevator status signals from the display equipment of the existing elevator to elevator group-supervisory means and supplying the manipulation equipment of the existing elevator with elevator manipulation signals from the group-supervisory means. Therefore, the alteration of the group supervision of an old elevator or an elevator manufactured by a different manufacturer is permitted without investigating the contents of the existing control circuit of the elevator.

What is claimed is:

1. A group-supervisory apparatus for an existing elevator comprising:

input means to read elevator status signals from display equipment of the existing elevator, group supervision means to execute group-supervisory processing of the existing elevator on the basis of the elevator status signals from said input means, output means to supply manipulation equipment of the existing elevator with elevator manipulation signals on the basis of outputs from said group supervision means, said display equipment including cage position indicators, cage running direction indicators, response lamps which are operated when cage calls have been registered, response lamps which are operated when hall calls have been registered, and said manipulation equipment including manipulation means disposed in the cages to be maintained for registering the cage calls.

2. A group-supervisory apparatus for an elevator as defined in claim 1 wherein:

said manipulation equipment includes manipulation means disposed in the cages for at least one of the following operations:

closing and opening the door, setting the up/down direction for the cages, and bypassing the hall calls.

3. A group-supervisory apparatus for an elevator as defined in claim 2 wherein said group supervision means is supplied with operating states of said indicators and said response lamps through said input means, thereby to obtain information items on positions of the cages, a generated status of the cage calls, a generated status of the hall calls and the running directions of the cages.

4. A group-supervisory apparatus for an elevator as defined in claim 3 wherein said group supervision means provides a command for performing a group-supervisory control of allotting the hall call to the optimum cage on the basis of the input information items, and the command is sent to the cage call registering manipulation means through said output means so as to register the corresponding cage call.

5. A group-supervisory apparatus for an elevator as defined in claim 4 wherein said group supervision means further provides a command for setting the running direction of the cage or bypassing the hall on the basis of the input information items, and the command is sent to the corresponding one of said up and down command manipulation means and said bypass command means through said output means so as to operate said corresponding means.

6. A group-supervisory apparatus for an elevator as defined in claim 2 wherein said manipulation means has a plurality of switches which are manipulated by passengers in the cage, said output means has a plurality of contacts which are connected in parallel with the respective switches, and said contacts are controlled 'on' and 'off' by said group supervision means so as to forcibly actuate said manipulation means.

7. A group-supervisory apparatus for an elevator as defined in claim 2 wherein said manipulation means has a plurality of switches which are manipulated by passengers in the cage, said output means supplies commands from said group supervision means to actuators which are associated with the respective switches and which turn 'on' and 'off' the corresponding switches, and predetermined ones of said switches are forcibly actuated by said actuators.

8. A group supervisory apparatus for an existing elevator which is connected to display equipment and to manipulation equipment associated with existing control circuits of the existing elevator and which detects signals representing status of the display equipment and transmits signals through the manipulation equipment to operate the elevator when the apparatus is connected, said apparatus comprising:

input means operating independently of the existing control circuits to detect elevator status signals from the display equipment of the existing elevator, said display equipment having light emitting elements;

said input means including input signal generator means producing input signals responsive to and representing energization of the display equipment light emitting elements;

group supervision means connected to receive said input signals from said signal generator means of said input means and to produce control signals representing group supervisory control commands for manipulating the existing elevator; and output means connected to said group supervisory means and to said manipulation equipment, said manipulation equipment including switching means connected to control up and down movement of the existing elevator;

said output means including means for generating signals transmitted through said switching means to control up and down movement of the existing elevator according to the group supervisory control commands represented by said control signals from said group supervision means.

* * * * *